US005664408A

United States Patent [19]

Chesterfield et al.

[11] Patent Number: 5,664,408

[45] Date of Patent: Sep. 9, 1997

[54] APPARATUS FOR VACUUM PACKAGING A SOFT PRODUCT

[76] Inventors: Michael P. Chesterfield; Jean M. Chesterfield, both of P.O. Box 4563, Emerald Isle, N.C. 28594

[21] Appl. No.: 546,468

[22] Filed: Oct. 20, 1995

[51] Int. Cl.[6] ..... B65B 7/06; B65B 31/06; B65B 51/10

[52] U.S. Cl. ..... 53/512

[58] Field of Search ..... 53/526, 527, 512, 53/510, 405, 434, 432

[56] References Cited

U.S. PATENT DOCUMENTS

| | | | |
|---|---|---|---|
| 2,790,284 | 4/1957 | Hultkrans | 53/405 |
| 3,376,690 | 4/1968 | Jianas | 53/512 |
| 3,377,769 | 4/1968 | Bridgeman | 53/512 X |
| 3,394,528 | 7/1968 | Tipper | 53/512 |
| 3,886,713 | 6/1975 | Mitchell et al. | 53/526 X |
| 3,910,011 | 10/1975 | Beninger | 53/526 |
| 4,110,954 | 9/1978 | Olsson et al. | 53/526 X |
| 5,239,808 | 8/1993 | Wells et al. | 53/512 |

*Primary Examiner*—James F. Coan
*Attorney, Agent, or Firm*—Olive & Olive, P.A.

[57] ABSTRACT

A method and apparatus for vacuum-packaging and heat sealing a soft product, particularly a soft product comprised substantially of fabric or other similar sheet material (referred to herein as "soft product"), having a substantially impervious outer covering in an impervious packaging barrier bag, which provides a packaged product which is compact and uniformly shaped. An air flow panel is inserted between the barrier bag and the product to permit air flow between the impervious layer of the soft product and the impervious layer of the barrier bag such that there is even air flow from the barrier bag during the evacuation of air from the barrier bag during vacuum-packaging. A packing frame is used during vacuum-packaging which assists in creating a compact, uniformly shaped vacuum-packed soft product.

3 Claims, 2 Drawing Sheets

APPARATUS FOR VACUUM PACKAGING A SOFT PRODUCT

BACKGROUND OF THE INVENTION

1. Field of the Invention

This invention relates to a method and apparatus for packaging a product, particularly a product comprised substantially of fabric or other similar sheet material (referred to herein as "soft product"), having a substantially impervious outer covering in an impervious packaging barrier bag in which the product is vacuum-packaged and heat sealed, and which provides a packaged product which is compact and uniformly shaped.

2. Description of the Related Art

The general method of vacuum-packaging is well-known. Many vacuum-packaged products are available in the market, particularly food products. The advantage of vacuum-packaging products is to protect the packaged product from effects of the environment, such as insects, moisture, air, and the like, as well as to provide a compact package suitable for compact shipping and handling.

There is a need to provide a method and apparatus for vacuum-packaging soft products, such as sleeping bags, jackets, and the like, so that the resulting package is compact, uniformly shaped, and is protected from environmental conditions. There is a particular need to provide a method and apparatus for vacuum-packaging a soft product having a substantially impervious outer covering in an impervious packaging barrier bag.

It is therefore an advantage of this invention to provide a method and apparatus for vacuum-packaging a soft product which results in a compact, uniformly shaped product.

It is also an advantage of this invention to provide a method and apparatus for vacuum-packaging a soft product which results in a package which protects the product from environmental conditions.

Other advantages will be more fully apparent from the following disclosure and appended claims.

SUMMARY OF THE INVENTION

The present invention is directed to a method and apparatus for vacuum-packaging a product, particularly a soft product comprised substantially of fabric or other similar flexible sheet material (referred to herein as "soft product"), having a substantially impervious outer covering in an impervious packaging barrier bag. The product is vacuum-packaged and heat sealed, which provides a packaged product which is compact, uniformly shaped, and protected from environmental conditions. The method and apparatus include the steps of inserting a product in a barrier bag; inserting an air flow panel between the barrier bag and the product so that the panel extends from the bottom seam of the barrier bag to the open end of the bag; and placing the barrier bag on a base panel of a packing frame. The packing frame has a base panel, a side wall extending vertically from the base panel, and a top panel hingedly attached to the side wall and closeable over the base panel. After the barrier bag is placed on the packing frame the evacuation of air from the barrier bag is initiated. During evacuation of air from the barrier bag, the top panel of the packing frame is closed onto the base panel of the packing frame and pressure is applied to the top panel until the top panel is horizontally parallel to the base panel. Once the top panel is parallel to the base panel, the top panel is lifted from the base panel to open the packing frame; the evacuation of air from the barrier bag is completed; the open end of the barrier bag is heat seated and the now sealed product-containing barrier bag is removed from the packing frame.

Important features of the invention include use of an air flow panel between the barrier bag and the product to permit air flow between the impervious layer of the soft product and the impervious layer of the barrier bag such that there is even air flow from the barrier bag during the evacuation of air from the barrier bag during vacuum-packaging. The invention also includes the use of a packing frame during vacuum-packaging which assists in creating a compact, uniformly shaped vacuum-packed soft product of the type described above.

Other aspects and features of the invention will be more fully apparent from the following disclosure and appended claims.

DETAILED DESCRIPTION OF THE INVENTION AND PREFERRED EMBODIMENTS THEREOF

Figure 1:
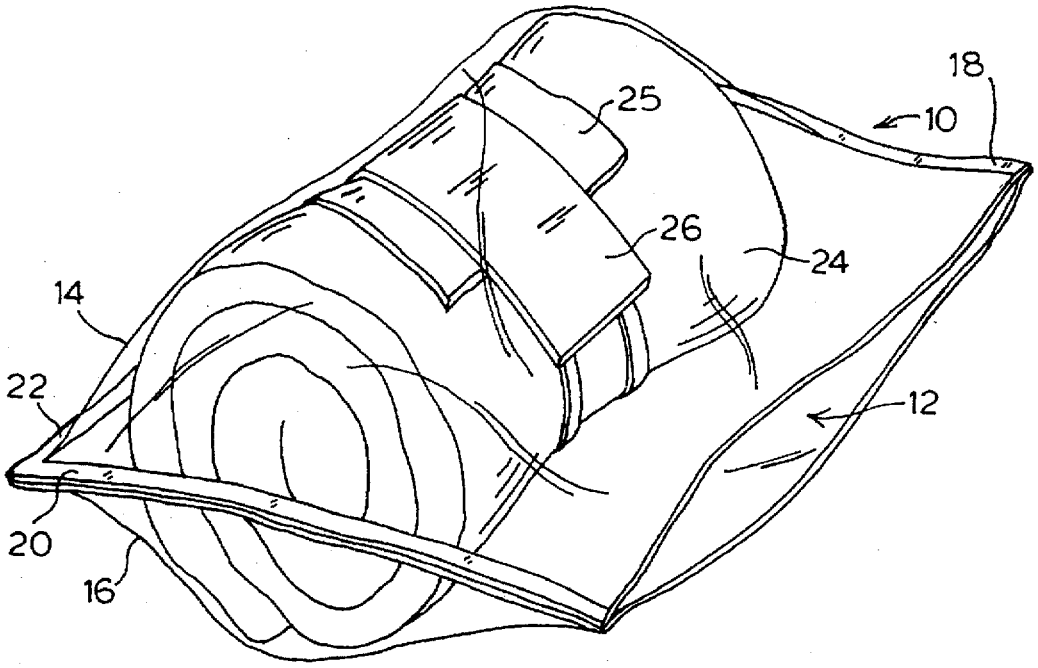
FIG. 1 is a top perspective view of a soft product inserted in a barrier bag with an air flow panel inserted between the product and the bag prior to vacuum-packaging.

The present invention comprises a method and apparatus for vacuum-packaging a soft product to create a protected, uniformly shaped package. For purposes of this description soft products are meant to include any product which has an outer covering which is substantially impervious, which by its nature restricts air flow through the covering, such as an outer covering which is a tightly woven fabric, and which may also be chemically treated in a manner typically utilized to make the outer covering water resistant and impervious to air and vapors. Typical products having such outer coverings are sleeping bags, certain jackets and coats and the like. Such products are often difficult to package because they are difficult to compress and form into uniformly shaped packages. Typically, such products are folded and packaged, but such packing results in ill-formed, bulky packages.

It is difficult to obtain uniformly shaped vacuum-packages of such soft products because in evacuating the air from a package containing a soft product, the air flow from the package is uneven due to the inability of the air to be evacuated evenly from between the substantially impervious outer covering of product 24 and impervious barrier bag 10, thus producing an ill-formed, loosely-packed package. The method and apparatus described herein alleviates these difficulties. While the invention is suitable for a number of soft products, the following description will use a typical adult-sized sleeping bag as an example, it being understood that a number of different soft products are suitable for packing in the manner described. A typical sleeping bag of this size when rolled up (as is the typical shape for storing and transporting the bag) forms a rolled product of approximately 30 centimeters (12 inches) in diameter and 43 centimeters (17 inches) high. The rolled sleeping bag for purposes of this description will be described as being in a vertical position when one end of the rolled sleeping bag is placed on the floor.

Figure 2:
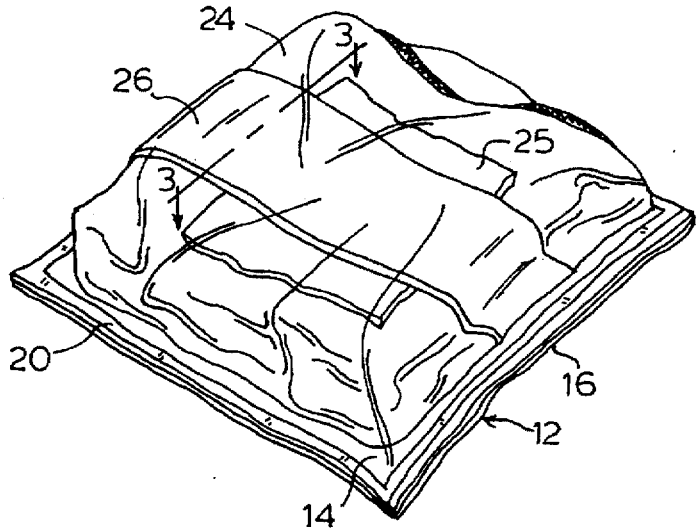
FIG. 2 is a top plan view of the barrier bag of FIG. 1 after being packaged by the vacuum-packaging method and with the apparatus of the invention.

In the process of the invention, product 24 is placed into barrier bag 10. A typical bag 10 is formed from a sheet of nylon-polymer material. A suitable bag 10 is Poly-Vac of the type available from Poly Sales Corporation of Miami, Fla. A typical barrier bag 10 for use with product 24 described above has the dimensions 56 centimeters (22 inches) by 86 centimeters (34 inches), and a thickness of approximately 4 mils. For purposes of this description barrier bag 10 will be described as having top sheet 14, bottom sheet 16, open end 12, left side seam 18, right side seam 20 and back seam 22, as shown in FIG. 1, and will refer to product 24 in position as shown generally in FIG. 1. Product 24 is first placed in barrier bag 10 in a vertical position, and then preferably rotated 90 degrees in barrier bag 10 so that the rolled ends of product 24 are adjacent to side seams 18 and 20 respectively, as shown in FIGS. 1 and 2. Rotating product 24 in bag 10 in this manner, assists in compacting product 24 in barrier bag 10, and in evacuating some of the excess air from barrier bag 10.

Figure 3:
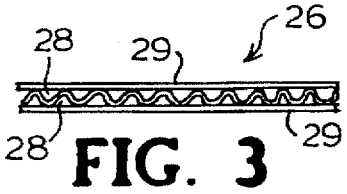
FIG. 3 is a cross-sectional view of the air flow panel shown in FIG. 2.

Once product 24 is in bag 10, air flow panel 26 is inserted between product 24 and top sheet 14 of barrier bag 10. While for convenience of illustration, air flow panel 26 is shown inserted on the top of product 24, air flow panel 26 is effectively inserted between bottom sheet 16 of barrier bag 10 and product 24. Air flow panel 26 is preferably a two-sheet structure having multiple channels 28 extending between sheets 29, as shown in FIG. 3, preferably all the way from one side of the barrier bag to the other. A suitable air flow panel 26 is formed from corrugated cardboard or plastic recycled for use from typically available packing boxes and well known in the art. Recycling boxes to create air flow panel 26 is an economical and convenient way to produce air flow panels 26. With barrier bag 10 of the dimensions described above, a suitable sized air flow panel 26 has the dimensions 13 centimeters (5 inches) by 51 centimeters (20 inches). It is preferable that channels 28 extend along the length of air flow panel 26 (e.g. the 20-inch length) for obtaining the most effective air flow from barrier bag 10 during vacuum-packaging. It is believed that channels 28 permit even air flow from barrier bag 10 during vacuum-packaging. Without channels 28, the impervious sheets 14 and 16 of barrier bag 10 contact the impervious outer layer of product 24 (e.g., water resistant outer covering of a sleeping bag) in a manner that severely restricts air flow through the bag during the vacuum-packaging which results in an ill-formed package which is not compact. Air flow panel 26 permits air to flow between the impervious layers of barrier bag 10 and of product 24 through the panel during vacuum-packaging.

Panels of a larger size may be used if desired without denim eat to the usefulness of the invention. While smaller panels do improve vacuum packaging as compared to use of no panels, particularly if they are large enough to span the space between the vacuum ports, the preferred size, discussed above, when used with standard sleeping bags optimizes the results. More than one panel can be used as well, and may be desired to shape the final product because of the stiffness of the panels.

Optionally, an accompanying soft product 25 is inserted into the product package, such as an air mattress as an accompanying product to a sleeping bag. In order to effectuate a uniformly shaped package, even with such accompanying product 25, it is crucial that air flow panel 26 is placed adjacent to barrier bag 10.

Figure 4:
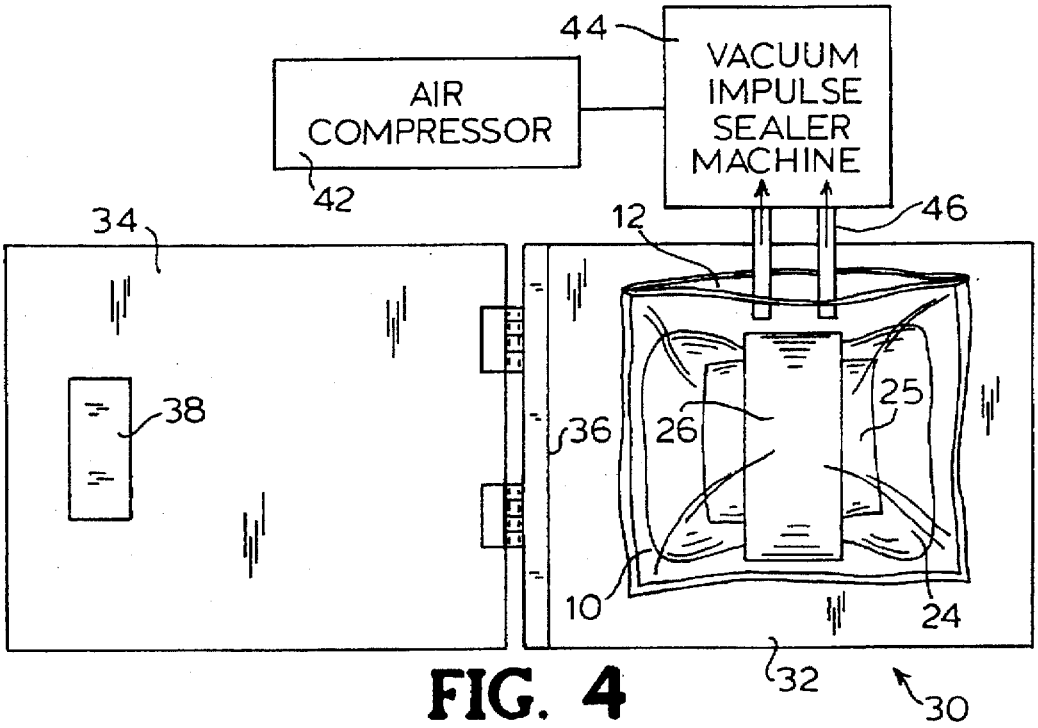
FIG. 4 is a top plan view of the apparatus for vacuum-packing a soft product showing a vacuum sealing machine and an air compressor representationally.
Figure 5:
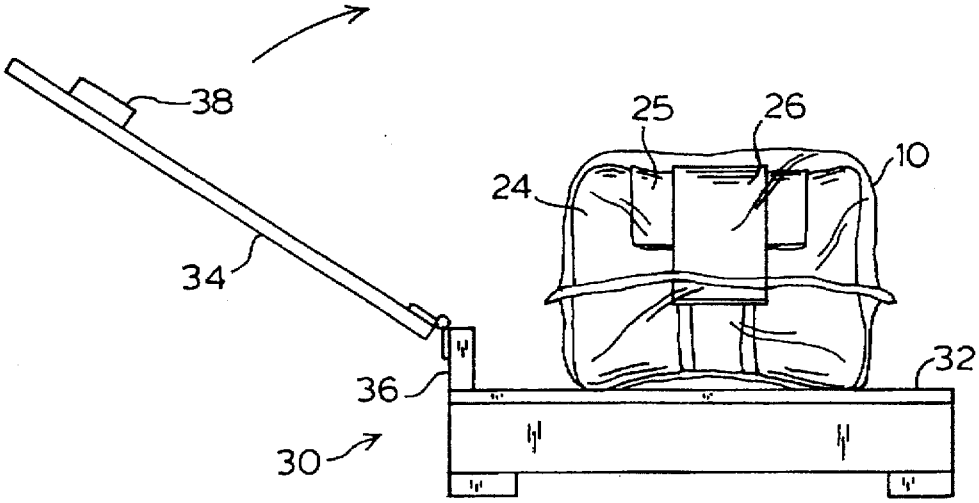
FIG. 5 is a side view of the packing frame of the apparatus of FIG. 4 in an open position showing the product in the barrier bag before vacuum-packaging.
Figure 6:
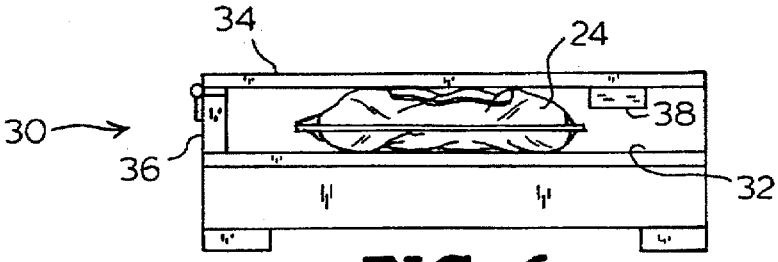
FIG. 6 is a side view of the packing frame of the apparatus of FIG. 5 in a closed position showing the product after vacuum-packaging.

Once air flow panel 26 is inserted into barrier bag 10, barrier bag 10 is placed into the packing frame 30, as shown in FIGS. 4 through 6. Packing frame 30, when used in the method of the invention, is described as having an open position, shown in FIGS. 4 and 5 and in a closed position, shown in FIG. 6, when top panel 34 is substantially parallel with and superimposed over bottom panel 32. Packing frame 30 comprises bottom panel 32, and top panel 34 of substantially the same shape and dimensions as bottom panel 32. Packing frame 30 preferably has side wall 36 to align barrier bag 10 in packing frame 30 and to space top panel 34 a specified vertical distance above bottom panel 32 when packing frame 30 is in a closed position. A suitable distance between bottom panel 32 and top panel 34 is approximately 7 centimeters (3 inches) to 16 centimeters (6 inches). The inside surface of top panel 34 has spacer 38 which keeps the two panels of the frame from closing completely together and determines the minimum height of the evacuated bag and product. For the size barrier bag 10 described above (22×34 inches), a suitable size packing frame 30 is approximately 71 centimeters (28 inches) by 58 centimeters (23 inches), and has side wall 36 of a height of most preferably approximately 9 centimeters (3½ inches) to create the spacing between bottom panel 32 and top panel 34 when in a closed position and essentially parallel. Packing frame 30 may also have supports such as wood 2×4's, under bottom panel 32 as shown in FIGS. 5 and 6.

Together with frame 30, the method of the invention utilizes vacuum impulse sealer 44, also referred to as a vacuum packaging machine and air compressor 42 to evacuate the air from barrier bag 10 and to heat seal product 24 in barrier bag 10 to create the vacuum-packaged and sealing product 24. A typical vacuum-packaging machine as known in the art provides the means for evacuating air from barrier bag 10. A number of suitable vacuum-packaging machines are available on the market for accomplishing the task. A suitable machine is a vacuum impulse sealer machine of the type available from Packaging Aids Corporation of San Francisco, Calif., as 24" vacuum impulse sealer, Model No. 24V. Such machine is powered by a suitable air compressor available on the market, such as the type available from Sears Roebuck of Chicago, Ill. under the tradename CRAFTSMAN, Model No. 919.155612. For vacuum-packaging a soft product 24 such as a sleeping bag in a barrier bag 10 of the size described above, a suitable power vacuum pump is a ½ horsepower pump.

To vacuum-package product 24 in barrier bag 10, once product 24 and air flow panel 26 are placed in barrier bag 10 as described above and after barrier bag 10 is placed in frame 30 on bottom panel 32, as shown in FIGS. 4 and 5, open end 12 of barrier bag 10 is placed over vacuum inlets 46 and between the two sealing jaws (not shown) of the vacuum-packaging machine 44 and the process of evacuating the air from barrier bag 10 is initiated by activating air compressor and vacuum impulse sealer 44 in accordance with the instructions provided by the manufacturers of those machines. As the air begins to leave barrier bag 10, top panel 34 of packing frame 30 is closed on top of base panel 32. Pressure is applied to top panel 34 of packing frame 30 until top panel 34 closes over barrier bag 10 and until top panel 34 is substantially horizontally parallel to bottom panel 34, as shown in FIG. 6. Once packing frame 30 is closed in that position, packing frame 30 can be opened. The evacuation of air is permitted to continue until all the air is removed from barrier bag 10. The vacuum-packaged barrier bag 10 containing product 24 is essentially a compact, uniformly shaped package. Packing frame 30 provides a method of compressing product 24 in barrier bag 10 in a uniform manner. A typical vacuum-packaging cycle on vacuum impulse sealer 44 as described above, for barrier bag 10 containing a sleeping bag of the type described above, is approximately 120 to 300 seconds per bag.

An inert gas is optionally injected into barrier bag 10 to further isolate the contents of barrier bag 10 from the environment but not in an amount to expand the size of the barrier bag beyond that desired for the particular product. Barrier bag 10 is then heat sealed using the sealing cycle on vacuum impulse sealer 44. A typical heat sealing time is approximately 1/10 second to approximately 5 seconds. The sealed barrier bag 10 is permitted to cool for approximately 2 to 15 seconds. After the cooling cycle, the product-filled barrier bag 10, now vacuum-packaged and heat sealed, is removed from packing frame 30.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. An apparatus for vacuum-packing an uncompressed soft product of a given height in a barrier bag, comprising:

(a) a vacuum packaging and sealing machine having at least one vacuum inlet extending outwardly therefrom;

(b) an air compressor operatively connected to said vacuum packaging and sealing machine;

(c) a packing frame comprising a horizontally oriented base panel, a side wall extending vertically from the base panel to a height which is less than the height of the soft product prior to being vacuum packed, and a top panel hingedly attached to the side wall and closeable over the base panel;

(d) said packing frame residing adjacent said vacuum packaging and sealing machine such that when said uncompressed soft product in said barrier bag is placed on said base panel said side wall provides the sole side closure around said barrier bag and said at least one vacuum inlet is engageable with an open end of said barrier bag; and (e) a flexible air flow panel adapted for being wrapped around said uncompressed product, and with said product inserted into the barrier bag in a manner enabling air within the barrier bag to flow through said air flow panel and to be conducted to said at least one vacuum inlet.

2. The apparatus as claimed in claim 1, in which said air flow panel is formed with a plurality of substantially parallel flexible channels capable of passing air therethrough.

3. A vacuum-packaging frame for creating a compact, uniformly shaped packaged soft product of a selected height, comprising a horizontal base panel, a side wall extending vertically from the base panel to a height substantially equal to said selected height of said soft product, and a top panel hingedly attached to the side wall and closeable over the base panel, said frame being adapted to receive a barrier bag in which said soft product is contained while resting on said base panel below said top panel during evacuation of air therefrom and during said evacuation said side wall providing the sole side closure around said barrier bag.

* * * * *

UNITED STATES PATENT AND TRADEMARK OFFICE

CERTIFICATE OF CORRECTION

PATENT NO. : 5,664,408
DATED : September 9, 1997
INVENTOR(S) : Michael P. Chesterfield, et al.

It is certified that error appears in the above-indentified patent and that said Letters Patent is hereby corrected as shown below:

Column 3, line 60, correct "denim eat" to read --detriment--.

Signed and Sealed this

Second Day of December, 1997

*Attest:*

*Attesting Officer*

BRUCE LEHMAN

*Commissioner of Patents and Trademarks*